US006894672B2

(12) United States Patent
Ruigt

(10) Patent No.: US 6,894,672 B2
(45) Date of Patent: May 17, 2005

(54) LIQUID CRYSTAL DISPLAY DEVICE

(75) Inventor: Adolphe Johannes Gerardus Ruigt, Heerlen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 424 days.

(21) Appl. No.: 09/801,625

(22) Filed: Mar. 8, 2001

(65) Prior Publication Data

US 2003/0189536 A1 Oct. 9, 2003

(30) Foreign Application Priority Data

Mar. 14, 2000 (EP) ..... 00200923

(51) Int. Cl.[7] ..... G09G 3/36

(52) U.S. Cl. ..... 345/97; 345/36; 345/67; 345/87; 345/93; 345/97; 345/98; 345/204; 345/206; 315/169.1; 315/169.3; 349/76

(58) Field of Search ..... 345/36, 67, 87, 345/93, 97, 98, 204, 206, 90, 101, 211, 212, 214; 315/169.1, 169.3; 349/76, 72, 117; 323/304; 327/512; 374/100, 178

(56) References Cited

U.S. PATENT DOCUMENTS 4,278,325 A 7/1981 Kondo et al. ..... 350/331
4,298,866 A * 11/1981 Hodemaekers ..... 345/101
4,425,027 A * 1/1984 Portmann ..... 349/199
5,088,806 A * 2/1992 McCartney et al. ..... 345/101
5,349,367 A * 9/1994 Wakita ..... 345/97
5,500,538 A * 3/1996 Yamazaki et al. ..... 257/49
5,589,960 A * 12/1996 Chiba et al. ..... 349/76
5,726,727 A * 3/1998 Shibahara et al. ..... 349/144
5,754,154 A * 5/1998 Katakura et al. ..... 345/97
5,805,131 A * 9/1998 Hartmann et al. ..... 345/101
5,850,205 A * 12/1998 Blouin ..... 345/102
5,923,311 A * 7/1999 Edwards ..... 345/92
5,940,184 A * 8/1999 Okabe ..... 358/296
5,949,194 A * 9/1999 Kawakami et al. ..... 315/169.4
5,995,456 A * 11/1999 Brewer et al. ..... 368/84
6,075,512 A * 6/2000 Patel et al. ..... 345/101
6,118,423 A * 9/2000 Rosenquist ..... 345/95
6,310,598 B1 * 10/2001 Koyama et al. ..... 345/98
6,388,649 B1 * 5/2002 Tanaka et al. ..... 345/89
6,411,272 B1 * 6/2002 Edwards ..... 345/87
6,412,977 B1 * 7/2002 Black et al. ..... 374/178
6,466,204 B1 * 10/2002 Oh ..... 345/213
2002/0180721 A1 * 12/2002 Kimura et al. ..... 345/211

FOREIGN PATENT DOCUMENTS

EP 0642113 A1 3/1995 ..... G98G/3/36

* cited by examiner

*Primary Examiner*—Bipin Shalwala
*Assistant Examiner*—Vincent E. Kovalick

(57) ABSTRACT

Compensation, e.g. temperature compensation of the operating voltage of an LCD is obtained by using the $V_{50}$ point of a test cell via the differentiated AC current (switching current of the test cell as a control parameter).

21 Claims, 2 Drawing Sheets

Figure 1:
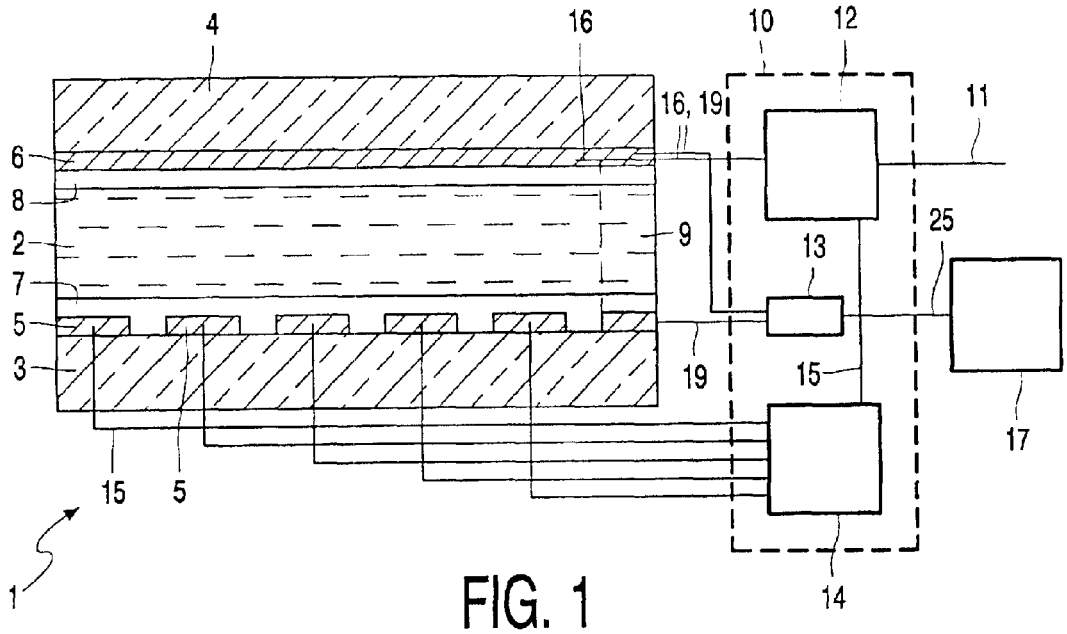

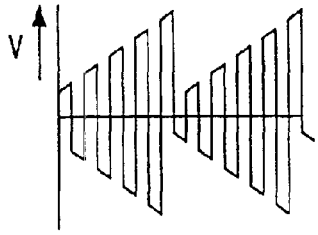
FIG. 4a
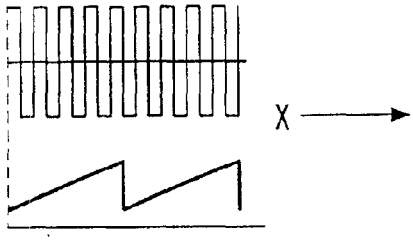
FIG. 4b
FIG. 4c
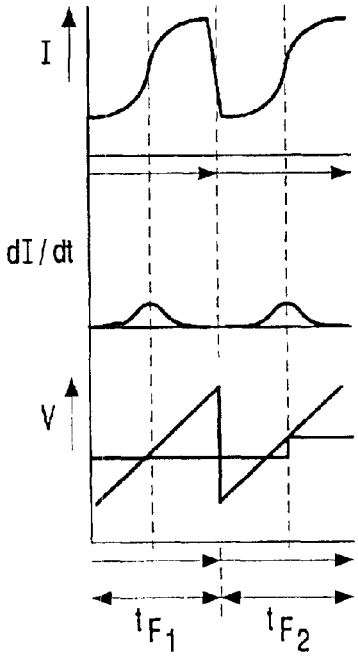
FIG. 5
FIG. 6
FIG. 7
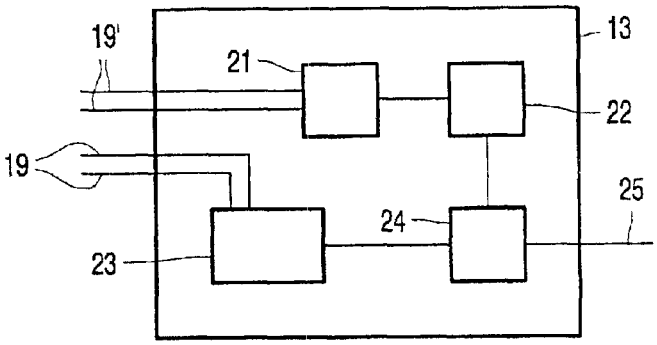
FIG. 8

LIQUID CRYSTAL DISPLAY DEVICE

The invention relates to a liquid crystal display device comprising a first substrate provided with electrodes and a second substrate provided with electrodes, and a twisted nematic liquid crystal material between the two substrates, in which, viewed perpendicularly to the substrates, overlapping parts of the electrodes define pixels.

Liquid crystal display devices of this type are generally known and are used, for example, in display screens for alphanumerical display devices in, for example, computing apparatus and measuring apparatus but also in car radios and telephone apparatus.

The operating voltage is adjusted after the manufacture of such liquid crystal display devices. This is usually effected via an external circuit because it is different for each display device due to different behavior of, for example, the liquid crystal material or other parts in the display device. This adjustment involves an extra operation which renders the whole manufacture extra expensive.

The use of such liquid crystal display devices may also cause problems at a varying ambient temperature because characteristic values such as threshold voltage and saturation voltage are temperature-dependent for the liquid crystal material. To be able to use the liquid crystal display devices in a wide temperature range, the drive voltages are usually adapted, dependent on the temperature. However, this means that the drive voltages are chosen from a fairly large voltage range, which requires a high power supply voltage for the drive electronics. Notably in portable apparatus, such as said measuring apparatus and telephone apparatus, which are usually battery-fed, this may lead to problems. Moreover, temperature-sensitive resistors whose resistance varies linearly with the temperature are often used for this correction. Since notably the variation of the switching voltage of the liquid crystal material is not always linear, an entirely correct adaptation of the switching voltage at varying temperatures will not always take place.

It is, inter alia, an object of the present invention to largely obviate one or more of the above-mentioned problems. It is another object of the invention to provide a liquid crystal display device, notably based on the STN effect (twist angles between 150 and 360°) which can be used in a wide temperature range.

To this end, a liquid crystal display device according to the invention is characterized in that the display device is provided with means for adjusting the operating voltage of the liquid crystal display device in dependence upon the switching behavior of a measuring element.

Said means provide the possibility of automatically adjusting the operating voltage, so that said extra step is superfluous.

Moreover, the adjusted operating voltage is thereby optimal so that a minimal quantity of unnecessary power is used.

A first embodiment of a liquid crystal display device according to the invention is characterized in that the means for adjusting the operating voltage of the display device comprise means for measuring the capacitance of the measuring element.

However, capacitance measurements cannot easily be integrated in a drive IC of a liquid crystal display device.

A preferred embodiment of a liquid crystal display device according to the invention is therefore characterized in that the means for adjusting the operating voltage of the display device comprise means for raising the operating voltage and simultaneously measuring the switching current in the measuring element.

These and other aspects of the invention are apparent from and will be elucidated with reference to the embodiments described hereinafter.

Figure 2:
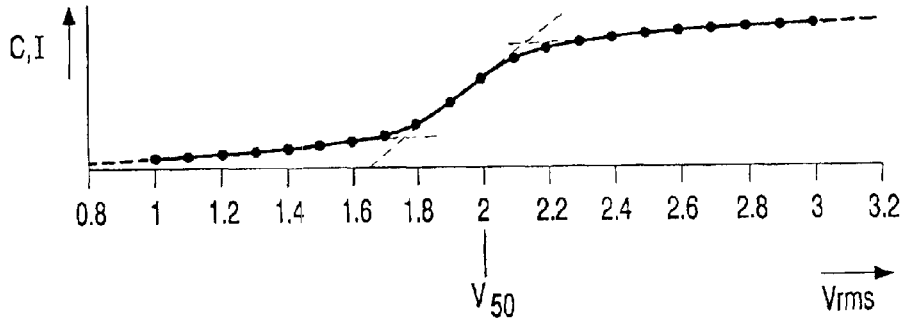
Figure 3:
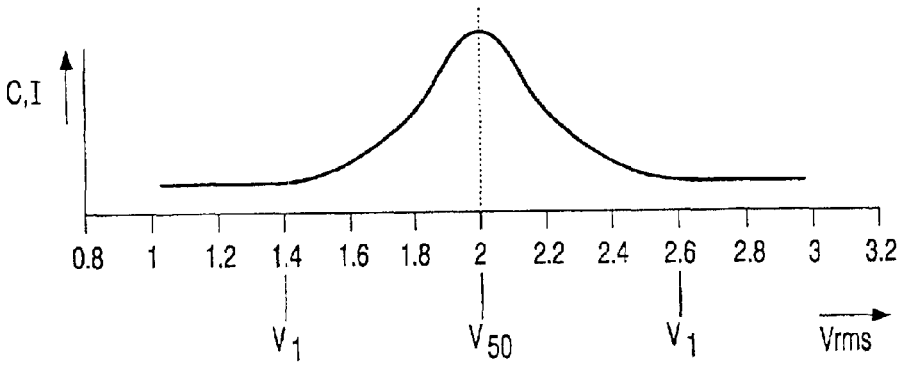

In the drawings:

FIG. 1 is a diagrammatic cross-section of a part of the display device, together with a diagrammatic representation of the drive section, FIG. 2 roughly shows the dependence of the current through a (measuring element) pixel (the capacitance of a (measuring element) pixel, respectively) as a function of the effective voltage ($V_{rms}$) across the pixel, FIG. 3 shows the derivative of the function as shown in FIG. 2, FIG. 4 shows a possible signal for activating a measuring element, while FIGS. 5 to 7 show possible derived signals for the purpose of detection, and FIG. 8 shows diagrammatically a part of the voltage control.

The Figures are diagrammatic and not drawn to scale. Corresponding elements are generally denoted by the same reference numerals.

FIG. 1 is a diagrammatic cross-section of a part of a liquid crystal display device, comprising a liquid crystal cell 1 with a twisted nematic liquid crystal material 2 present between two supporting plates or substrates 3 and 4 of, for example, glass or quartz, with selection electrodes 5 and data electrodes 6 in this embodiment. The liquid crystal material (for example, MLC3700 of the firm of Merck) has a positive optical anisotropy, a positive dielectric anisotropy and a low threshold voltage in this case. If necessary, the device comprises polarizers (not shown) whose directions of polarization are, for example, mutually crossed perpendicularly. The device further comprises orientation layers 7, 8 which orient the liquid crystal material on the inner walls of the substrates in such a way that the twist angle is, for example, 270°. The display device is of the passive type but may also be provided with active switching elements which connect picture electrodes to drive electrodes.

In the drive section 10, incoming information 111 is processed, if necessary, and stored in a data register 12, and presented to the data electrodes 6 via data signal lines 16. Pixels, here arranged in rows and columns, are selected by consecutively selecting row electrodes 5 which are connected to a multiplex circuit 14 via row signal lines 15. Mutual synchronization between the multiplex circuit 14 and the data register 12 is ensured by the line 15. After all row electrodes have been selected, this selection is repeated. The display device is also provided with a power supply source 17 shown diagrammatically, which supplies, inter alia, the operating voltage of the liquid crystal display device.

According to the invention, the display device also comprises a measuring element 9 which is shown diagrammatically and is connected via signal lines 19 to a control section 13 of the drive section 10 indicated by broken lines. A pixel, whose kind of measuring value to be described is periodically measured, may also be used as a measuring element. The variation of the current I through such a measuring element (pixel) as a function of the effective voltage ($V_{rms}$) across the measuring element (pixel) is shown in FIG. 2. The solid-line curve shows the actually measured curve, whereas the broken line curve represents an idealized curve. The units on the Y axis are scaled. A similar curve applies to the capacitance C of the measuring element.

As regards shape, these curves can be compared with the transmission/voltage characteristic of the pixels. Notably, the voltage associated with the steepest part of the transition and hence the peak of the differentiated curve as shown in FIG. 3 corresponds to the voltage value $V_{50}$, which is the value where the transmission is 50% of the maximum transmission; this value is directly coupled to other characteristic values such as the threshold voltage or the saturation voltage in the transmission/voltage characteristic of the display device. This value is particularly coupled to the operating voltage $V_{op}$ and drive voltages derived therefrom.

In the control section 13, a square-wave voltage (a, FIG. 4) rising in effective value is generated in a voltage generator at an appropriate instant, for example, by mixing a square-wave (b in FIG. 4) and a ramp voltage (c in FIG. 4), which voltage is applied to a measuring element 23 via signal lines 19' during one or more frame periods $t_F$. FIG. 5 shows the associated current through the measuring element which is measured in measuring unit 21 via signal lines 19. The differential circuit 22 determines the derived current, as is shown in FIG. 6. The value of the derived current is applied to computing unit 24. A sawtooth voltage related to said ramp voltage (c in FIG. 4) is also applied from measuring element 23 to the computing unit 24. The computing unit 24 is adapted in such a way that the occurrence of the maximum value in the derived current, as shown in FIG. 6, is related to a coincident voltage of the sawtooth voltage and hence of the presented $V_{rms}$. In this way, an indication (analog or digital) for $V_{50}$ is obtained, which is fed back via the line 25 to the power supply unit 17 in which the operating voltage is adjusted on the basis of the indication obtained. In the (diagrammatic) example of FIGS. 5 to 7, the value of $V_{50}$ is higher during the frame period $t_{F2}$ than during the frame period $t_{F1}$ and the operating voltage will be raised (in this example).

The invention is of course not limited to the embodiment shown, but several variations are possible within the scope of the invention. For example, intermittent measurements may take place, with $V_{50}$ not being determined during each frame period but, for example, once per n frame periods (n>100). Notably in the latter case, a pixel may be used for measuring so that it is not necessary to provide an extra measuring element. Where in this example, the calibration point is determined by $V_{50}$, other points on the curve in FIG. 3 may be chosen alternatively, for example, the points $V_1$ and/or $V_2$ which are related to, for example, the on and off voltages of a display element. Several variations are also possible for realizing the control section 13.

The protective scope of the invention is not limited to the embodiments shown. The invention resides in each and every novel characteristic feature and each and every combination of characteristic features. Any reference numerals in the claims do not limit their protective scope. The use of the verb "to comprise" and its conjugations does not exclude the presence of elements other than those stated in the claims. The use of the indefinite article "a" or "an" preceding an element does not exclude the presence of a plurality of such elements.

What is claimed is:

1. A liquid crystal display device, comprising:

a first substrate provided with one or more first electrodes, a second substrate provided with one or more second electrodes, and a twisted nematic liquid crystal material between the two substrates, in which, viewed perpendicularly to the substrates, overlapping parts of the electrodes define pixels, wherein the display device is provided with means for adjusting an operating voltage of the liquid crystal display device by:

supplying an input voltage to a measuring element positioned between the first and second substrates;

measuring a current through the measuring element, the current based on the input voltage;

determining a derived current using the measured current; and adjusting the operating voltage using the derived current; and wherein the means for adjusting are capable of adjusting the operating voltage using the derived current by:

identifying a maximum value in the derived current; and identifying a voltage in a sawtooth voltage signal that is coincident with the maximum value in the derived current, the identified voltage in the sawtooth voltage signal comprising the operating voltage of the liquid crystal display device.

2. A liquid crystal display device as claimed in claim 1, wherein the means for adjusting the operating voltage or the display device comprise means for measuring a current through the measuring element.

3. A liquid crystal display device as claimed in claim 2, wherein the means for adjusting the operating voltage of the display device comprise means for raising the operating voltage and measuring a peak current through the measuring element.

4. A liquid crystal display device as claimed in claim 1, wherein the means for adjusting the operating voltage of the display device comprise means for measuring a capacitance of the measuring element.

5. A liquid crystal display device as claimed in claim 1, wherein the measuring element comprises a portion of the liquid crystal material.

6. A liquid crystal display device, comprising:

a first substrate provided with one or more first electrodes;

a second substrate provided with one or more second electrodes; and a twisted nematic liquid crystal material between the two substrate, in which, viewed perpendicularly to the substrates, overlapping parts of the electrodes define pixels;

wherein the display device is provided with means for adjusting an operating voltage of the liquid crystal display device based on one or more measurements involving a measuring element positioned between the first and second substrates, the means for adjusting the operating voltage of the display device comprising means for raising the operating voltage and simultaneously measuring the current through the measuring element.

7. A liquid crystal display device, comprising:

a first substrate comprising one or more first electrodes;

a second substrate comprising one or more second electrodes;

a liquid crystal material between the first and second substrates, wherein at least portions of the electrodes that overlap when viewed define pixels;

a measuring element positioned between the first and second substrates; and a controller operable to adjust an operating voltage of the liquid crystal display device based on one or more measurements involving the measuring element by raising the operating voltage and simultaneously measuring a current through the measuring element.

8. The liquid crystal display device of claim 7, wherein the one or more measurements measure at least one of:

a current through the measuring element;

a peak current through the measuring element; and a capacitance of the measuring element.

9. The liquid crystal display device of claim 7, wherein the controller is operable to adjust the operating voltage of the liquid crystal display device at varying ambient temperatures.

10. The liquid crystal display device of claim 7, wherein the measuring element comprises a portion of the liquid crystal material.

11. The liquid crystal display device of claim 7, further comprising a power supply operable to provide the operating voltage.

12. The liquid crystal display device of claim 7, wherein the liquid crystal material comprises twisted nematic liquid crystal material.

13. A liquid crystal display device, comprising:

a first substrate comprising one or more first electrodes;

a second substrate comprising one or more second electrode;

a liquid crystal material between the first and second substrates, wherein at least portions of the electrodes that overlap when viewed define pixels;

a measuring element positioned between the first and second substrates; and a controller operable to adjust an operating voltage of the liquid crystal display device based on one or more measurements involving the measuring element, wherein the controller is operable to adjust the operating voltage of the liquid crystal display device such that a transmission strength of the pixels is fifty percent of a maximum transmission strength.

14. A method, comprising:

identifying at least one operational characteristic of a measuring element positioned between a first substrate and a second substrate of a liquid crystal display device; and adjusting an operating voltage of the liquid crystal display device based on the at least one identified operational characteristic such that a transmission strength of pixels in the liquid crystal display device is fifty percent of a maximum transmission strength.

15. The method of claim 14, wherein the at least one operational characteristic of the measuring element comprises at least one of:

a current through the measuring element;

a peak current through the measuring element; and a capacitance of the measuring element.

16. The method of claim 14, wherein adjusting the operating voltage of the liquid crystal display device comprises adjusting the operating voltage at varying ambient temperatures.

17. The method of claim 14, wherein the measuring element comprises a portion of a liquid crystal material between the first and second substrates.

18. The method of claim 14, wherein the liquid crystal material comprises twisted nematic liquid crystal material.

19. A liquid crystal display device, comprising:

a first substrate provided with one or more first electrodes;

a second substrate provides with one or more electrodes; and a twisted nematic liquid crystal material between the two substrates, in which, viewed perpendicularly to the substrates, overlapping parts of the electrodes define pixels;

wherein the display device provided with means for adjusting an operating voltage of the liquid crystal display device using a derived current associated with a current through a measuring element positioned between the first and second substrates; and wherein the means for adjusting are capable of adjusting the operating voltage using the derived current by:

identifying a maximum value in the derived current; and identifying a voltage in a sawtooth voltage signal that is coincident with the maximum value in the derived current, the identified voltage in the sawtooth voltage signal comprising the operating voltage of the liquid crystal display device.

20. The liquid crystal display device of claim 19, wherein:

the input voltage comprises a square-wave voltage signal mixed with a ramp voltage signal to produce a square-wave voltage signal rising in effective value; and the sawtooth voltage signal is related to the ramp voltage signal.

21. A liquid crystal display device, comprising:

a first substrate provided with one or more first electrodes;

a second substrate provided with one or more second electrodes;

a twisted nematic liquid crystal material between the two substrates, in which, viewed perpendicularly to the substrates, overlapping parts of the electrodes define pixels; and an operating voltage adjuster capable of adjusting an operating voltage of the liquid crystal display device using a derived current associated with a current through a measuring element positioned between the first and second substrates, the operating voltage adjuster capable of adjusting the operating voltage using tho derived current by:

identifying a maximum value in the derived current; and identifying a voltage in a sawtooth voltage signal that is coincident with the maximum value in the derived current, the identified voltage in the sawtooth voltage signal comprising the operating voltage of the liquid crystal display device.

* * * * *